US008291688B2

(12) United States Patent
Davis, Jr. et al.

(10) Patent No.: US 8,291,688 B2
(45) Date of Patent: Oct. 23, 2012

(54) FUEL NOZZLE TO WITHSTAND A FLAMEHOLDING INCIDENT

(75) Inventors: Lewis Berkley Davis, Jr., Schenectady, NY (US); Stanley Kevin Widener, Greenville, SC (US); John Wilbur, Bristol, CT (US)

(73) Assignee: General Electric Company, Schenectady, NY (US)

( * ) Notice: Subject to any disclaimer, the term of this patent is extended or adjusted under 35 U.S.C. 154(b) by 1502 days.

(21) Appl. No.: 12/059,493

(22) Filed: Mar. 31, 2008

(65) Prior Publication Data

US 2009/0241508 A1 Oct. 1, 2009

(51) Int. Cl.
*F02C 1/00* (2006.01)

(52) U.S. Cl. ..... 60/39.091; 60/740

(58) Field of Classification Search ..... 60/39.091, 60/39.094, 737, 740, 223
See application file for complete search history.

(56) References Cited

U.S. PATENT DOCUMENTS 5,685,139 A * 11/1997 Mick et al. ..... 60/776
6,599,028 B1 * 7/2003 Shu et al. ..... 385/80
7,437,871 B2 * 10/2008 Cook ..... 60/39.091

* cited by examiner

*Primary Examiner* — Louis Casaregola
(74) *Attorney, Agent, or Firm* — Cantor Colburn LLP

(57) ABSTRACT

A nozzle is provided and includes an outer annulus defined by an exterior wall and an interior wall and including air inlets through which air flows to a fuel mixing zone and a combustion zone, an inner annulus disposed within the interior wall and including a fuel volume into which fuel is fed to a distal end thereof, which is adjacent to and isolated from the combustion zone and an airflow line, disposed between the fuel volume and the interior wall, through which air flows to the combustion zone with the airflow line and the combustion zone isolated from the fuel volume, and a fuse configured to melt during a flameholding incident and to form a breach through which fuel flows from the fuel volume, bypassing the fuel mixing zone, to a fuel burning zone downstream from the fuel mixing zone.

13 Claims, 3 Drawing Sheets

FUEL NOZZLE TO WITHSTAND A FLAMEHOLDING INCIDENT

BACKGROUND

Aspects of the present invention are directed to premixed combustion systems and, more particularly, to gas turbine combustors employing premixed combustion systems as well as premixed combustion systems in other contexts.

Generally, gas turbine combustors employ premixed combustion systems that are designed to fully mix air and fuel prior to combustion. In this way, the gas turbine combustors are able to achieve lower emissions than comparative diffusion combustion system in which the fuel and the air mix as they burn.

Premixed combustion systems of gas turbine combustors are, however, subject to a failure mode called flameholding. In flameholding, a flame is initiated and then persists within a zone of the combustor that is intended for fuel mixing without burning. In detail, during normal operation, the flame persists at the discharge or burning zone of the nozzle (see region A in FIG. 1) while, during abnormal operation, such as the flameholding incident, the flame persists within the premixing annulus (see region B in FIG. 1) where the flame may cause damage as well as a failure of the low-emissions function of the fuel nozzle.

BRIEF DESCRIPTION OF THE INVENTION

In accordance with an aspect of the invention, a nozzle to avoid excess damage resulting from a flameholding incident occurring when a flame is formed and persists excessively close to nozzle hardware is provided and includes an outer annulus defined by an exterior wall and an interior wall, the outer annulus including air inlets through which air flows to a fuel mixing zone within the outer annulus and a combustion zone, an inner annulus disposed within the interior wall of the outer annulus and including a fuel volume into which fuel is fed up to a distal end thereof, which is adjacent to and isolated from the combustion zone, and an airflow line, disposed between the fuel volume and the interior wall, through which the air flows to the combustion zone with the airflow line and the combustion zone being isolated from the fuel volume, and a fuse. The fuse is disposed on the interior wall of the outer annulus and is configured to melt during the flameholding incident and to thereby form a breach through which fuel flows from the distal end of the fuel volume to a fuel burning zone within the outer annulus and downstream from the fuel mixing zone.

In accordance with another aspect of the invention, a nozzle to avoid excess damage resulting from a flameholding incident occurring when a flame is formed and persists excessively close to nozzle hardware is provided and includes an outer annulus defined by an exterior wall and an interior wall, the outer annulus including air inlets through which air flows to a fuel mixing zone within the outer annulus and a combustion zone, an inner annulus disposed within the interior wall of the outer annulus and including a fuel volume into which fuel is fed up to a distal end thereof, which is adjacent to and isolated from the combustion zone, and an airflow line, disposed between the fuel volume and the interior wall, through which the air flows to the combustion zone, a bulkhead including first passages through which air is provided from the airflow line to the combustion zone and second passages, the bulkhead being configured to isolate the airflow line and the combustion zone from the fuel volume, and a fuse. The fuse is disposed on the interior wall of the outer annulus and is configured to melt during the flameholding incident and to thereby form a breach through which fuel flows via the second passages of the bulkhead from the distal end of the fuel volume to a fuel burning zone within the outer annulus and downstream from the fuel mixing zone.

In accordance with another aspect of the invention, a nozzle to avoid excess damage resulting from a flameholding incident occurring when a flame is formed and persists excessively close to nozzle hardware is provided and includes a fuel volume, defined by a wall of an annulus of the nozzle, into which fuel is fed to a distal end thereof, which is adjacent to and isolated from a combustion zone of the nozzle, an airflow line, disposed at an exterior of the fuel volume, through which air flows to the combustion zone with the airflow line and the combustion zone being isolated from the fuel volume, and a fuse disposed in the wall of the fuel volume, which is configured to melt during the flameholding incident and to thereby form a breach through which fuel flows from the distal end of the fuel volume to a fuel burning zone of the nozzle located downstream from a fuel mixing zone of the nozzle.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION OF THE INVENTION

Figure 1:
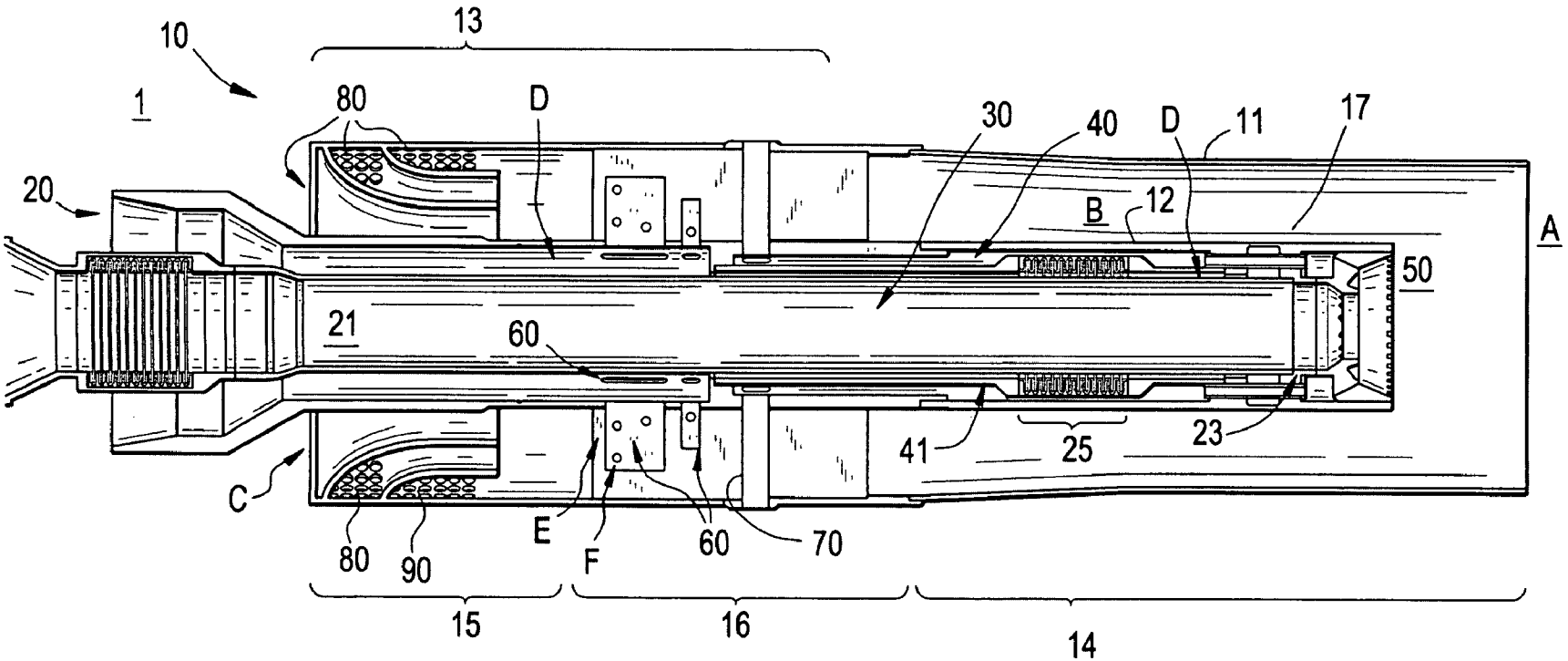
FIG. 1 is a sectional view of a nozzle in accordance with an exemplary embodiment of the invention.
Figure 2:
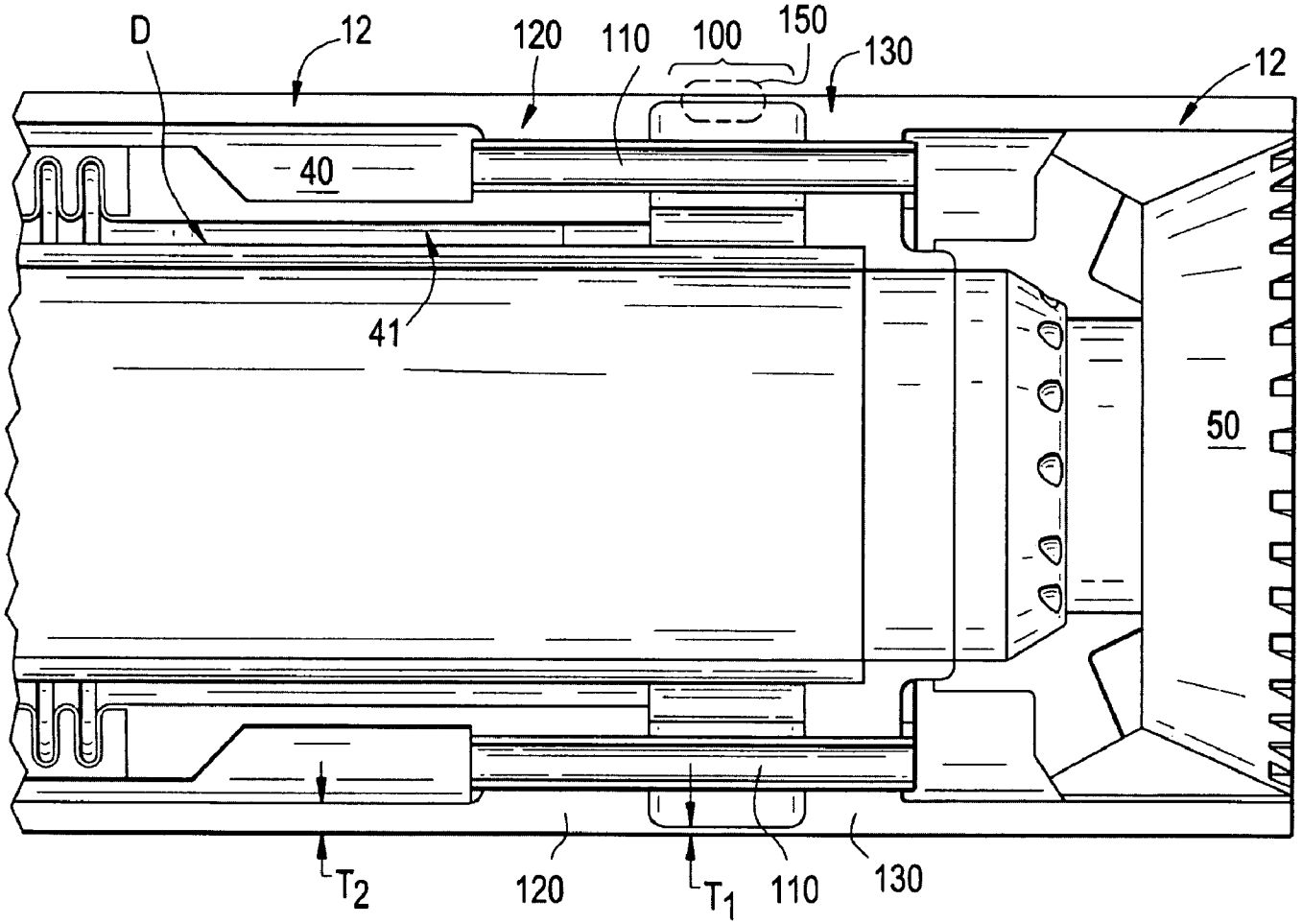
FIG. 2 is an exploded sectional view of the nozzle of FIG. 1.

Referring to FIGS. 1 and 2, a nozzle 1 is provided that is capable of withstanding or otherwise containing a flameholding incident, in which a flame is formed excessively proximate to the nozzle 1 hardware. As noted above, during normal operation, the flame persists at the discharge or burning zone of the nozzle 1 (see region A in FIG. 1) while, during abnormal operation, such as the flameholding incident, the flame persists within the region B of FIG. 1 where the flame may cause damage as well as a failure of low-emissions functions of the nozzle 1.

The nozzle 1 includes an outer annulus 10 having a shape that is generally defined by an exterior cylindrical wall 11 and an interior cylindrical wall 12 (hereinafter referred to as "exterior wall 11" and "interior wall 12"). The outer annulus 10 includes a set of air inlets 80 through which air flows to a fuel mixing zone 16 defined within the outer annulus 10 and, then, to the burning zone A.

The nozzle 1 further includes an inner annulus 20 disposed generally between the interior wall 12 of the outer annulus 10 and the inner wall 30 of the inner annulus. The inner annulus 20 contains fuel within a fuel volume D that extends up to the distal end 23 of the nozzle 1. The fuel within fuel volume D normally flows into premixed fuel supply ports 60 within swirl vanes E, and through fuel injector holes F in the sides of the swirl vanes F to thereby mix with the air flow in outer annulus 10.

The inner annulus 20 further includes an airflow line 40, disposed between the inner wall 30 and the interior wall 12 of the outer annulus 10, through which air flows to a diffusion combustion zone 50. Here, the airflow line 40 and the combustion zone 50 are each isolated from the fuel volume D. The airflow line 40 is separated from the fuel volume D by a substantially cylindrical wall 41. Bellows 25 are disposed along the cylindrical wall 41 to permit differential thermal growth between the cylindrical wall 41 and the inner wall 30. Air enters the airflow line 40 via ports 70 that pass through the swirl vanes E from the outer side of outer wall 11, which is surrounded by pressurized air.

Within the inner wall 30 of the inner annulus 20 is a cylindrical volume 21 at the centerline of the nozzle that may accommodate various apparatuses that are not directly related to this invention and are not shown in FIG. 1. Such apparatuses may include additional fuel injection equipment to provide fuel to the diffusion combustion zone 50.

The outer annulus 10 further includes a first end 13 and a second end 14. The air inlets 80 are disposed within an air inlet portion 15 of the first end 13. The swirl vane E, which is configured to generate a turbulent airflow within the fuel mixing zone 16, is also disposed within the first end 13. The fuel burning zone 17 is disposed within the second end 14. Under normal operation, flame should not be present within the fuel burning zone 17.

Referring to FIG. 2, a fuse 100 is disposed on the interior wall 12 of the outer annulus 10. The fuse 100 is configured to melt during the flameholding incident and to thereby form a breach in the interior wall 12 through which fuel would then be able to flow from the distal end 23 of the fuel volume D to a fuel burning zone 17 within the outer annulus 10 and downstream from the fuel mixing zone 16.

In accordance with an embodiment of the invention, the cylindrical wall 41 and a first bulkhead 120 are configured to cooperatively isolate the fuel volume D from the airflow line 40. Similarly, a second bulkhead 130 is configured to isolate the fuel volume D from the diffusion combustion zone 50. A set of tubes 110 extend from the first bulkhead 120 to the second bulkhead 130 to allow for the provision of the air from the airflow line 40 to the diffusion combustion zone 50. The fuse 100 is disposed within the interior wall 12 of the outer annulus 10 at a location corresponding to an axial location of the tubes 110, and includes a portion of the interior wall 12 that has a thickness, T1, which is thinner than another portion of the interior wall 12, which has a thickness, T2. That is, the thickness of the fuse 100 is determined such that, during a flameholding incident, the fuse 100 melts in a time that is significantly shorter than the time required for the interior wall 12, at thickness T2, to reach its melting temperature.

Once the fuse 100 melts, a breach forms and allows fuel to escape from the fuel volume D and to thereby bypass the fuel injector holes F. Once fuel bypasses the fuel injector holes F, the fuel-air mixture within the mixing zone is no longer rich enough to burn, and the flame is extinguished and thereby prevented from causing further hardware damage. Whereas the fuel nozzle may have sustained minor damage in the breach of the fuse, major damage that would result from the interior wall 12 melting is averted.

In an embodiment of the invention, a set of 4 fuses 100 are equally spaced from one another and disposed around a circumference of the interior wall 12. Here, each fuse 100 occupies about 30° of the circumferential length of the interior wall 12. Moreover, the thickness, T1, of each fuse 100 may be about 0.043-0.058 cm thick, while the thickness, T2, of the pillars of the interior wall 12 outside of the fuse 100 edges may be at least about 1.87-1.94 cm thick.

In an embodiment of the invention, a set of about 20 tubes 110 may be employed to allow for the provision of the air from the airflow line 40 to the combustion zone 50. In this case, the tubes 110 may be circumferentially separated from one another by about 18°.

Of course, it is understood that the fuse 100 could be formed in other ways and with materials which are different from those of the interior wall 12. For example, the fuse 100 could have the same or a larger thickness as compared to the interior wall 12 but be formed of a material that is designed to melt at a lower temperature during the flameholding incident. Here, the material would still have to be otherwise capable of maintaining the integrity of the interior wall 12.

Figure 3:
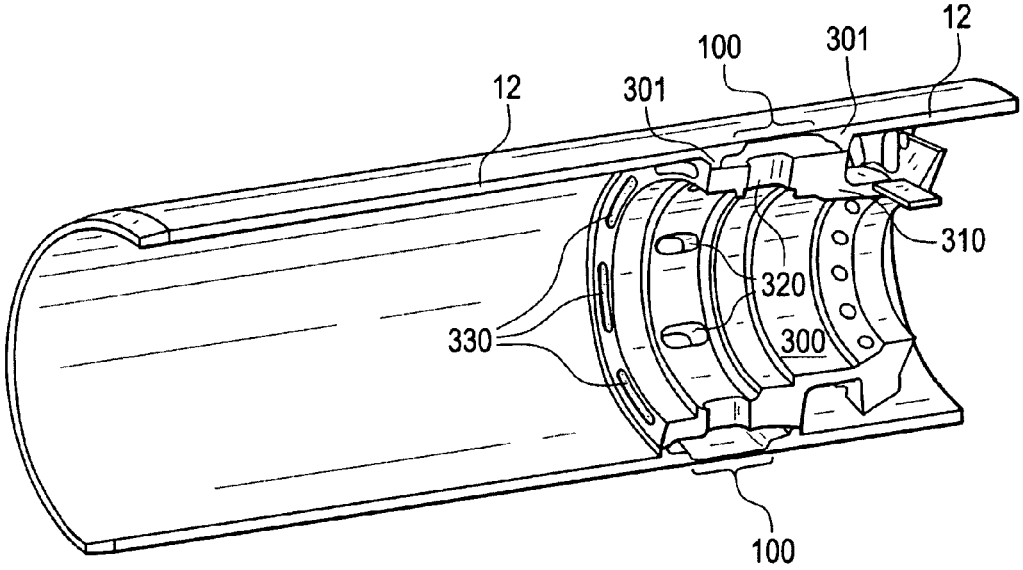
FIG. 3 is a perspective view of a section of a nozzle in accordance with an exemplary embodiment of the invention.

With reference to FIG. 3, in accordance with another embodiment of the invention, a bulkhead 300 may be installed within the inner annulus 20 and attached thereto at joints 301, which may be welded or brazed. The bulkhead 300 includes a body 310 through which first passages 330 and second passages 320 are defined. In this embodiment, air is provided from the airflow line 40 to the combustion zone 50 via the first passages 330 and the fuse 100 operates in a similar manner as described above. Thus, once the fuse 100 melts and forms the breach, fuel flows from the distal end 23 of the fuel volume D to a fuel burning zone 17 within the outer annulus 10 via the second passages 320 of the bulkhead 300.

Here, a set of about 8 first passages 330 and second passages 320 may be employed. The first passages 330 may be circumferentially separated from one another by about 45° while the second passages 320 may also be circumferentially separated from one another by about 45°.

In an embodiment of the invention, a sensor 150 (see FIG. 2) may be operably coupled to the fuse 100 to sense either the melting of the fuse or the presence of the breach. Here, the sensor 150 may generate a signal that a flameholding incident has occurred. This signal could then be outputted to an operator who could then determine whether a shutdown of the corresponding nozzle 1 is necessary. Alternately, the signal may be outputted directly to a controller (not shown) that would then automatically shut the corresponding nozzle 1 down.

Figure 4:
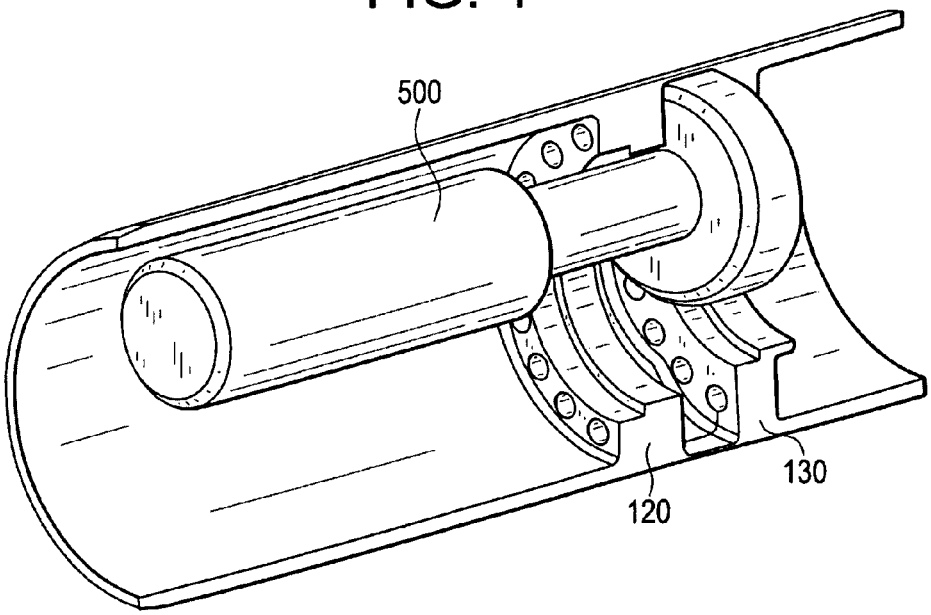
FIG. 4 is a perspective illustration of a method of forming a nozzle in accordance with an exemplary embodiment of the invention.

With reference to FIG. 4, a method of forming a nozzle to withstand a flameholding includes forming two bulkheads 120 and 130 within an inner annulus 20 of the nozzle 1 to each abut an interior wall 12 that defines a shape of the inner annulus 20. The forming of the bulkheads thereby isolates an airflow line 40, a fuel volume D and a combustion zone 50 from one another within the inner annulus 20. Material is then removed from an interior surface of the interior wall 12 at a position that is located between the two bulkheads 120 and 130. At this position, the interior wall 12 is in communication with the fuel volume. Once the material is removed, a communication of air from the airflow line 40 and to the diffusion combustion zone 50 is provided for.

According to embodiments of the invention, the removal of the material from the interior surface of the wall includes machining the interior surface of the wall with, e.g., a "T" cutter 500 that is inserted into the inner annulus 20 from the forward side. Further, the providing for the communication between the airflow line and the combustion zone includes drilling apertures through the two bulkheads, and installing tubes 110 through the apertures from the airflow line 40 to the diffusion combustion zone 50.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Dimensions and areas heretofore described are particular to a limited number of embodiments and are not limiting to the scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle to avoid excess damage resulting from a flameholding incident occurring when a flame is formed and persists excessively close to nozzle hardware, comprising:

an outer annulus defined by an exterior wall and an interior wall and including air inlets through which air flows to a fuel mixing zone within the outer annulus and a combustion zone;

an inner annulus disposed within the interior wall of the outer annulus and including:

a fuel volume into which fuel is fed to a distal end thereof, which is adjacent to and isolated from the combustion zone, and an airflow line, disposed between the fuel volume and the interior wall, through which air flows to the combustion zone with the airflow line and the combustion zone being isolated from the fuel volume; and a fuse disposed on the interior wall of the outer annulus and configured to melt during the flameholding incident and to thereby form a breach through which fuel flows from the distal end of the fuel volume to a fuel burning zone within the outer annulus and downstream from the fuel mixing zone.

2. The nozzle according to claim 1, further comprising fuel injector holes, disposed at an upstream position within the fuel mixing zone, which are configured to communicate with the fuel volume and to thereby allow for the feeding of the fuel to the fuel mixing zone and thereby to a premixed combustion zone.

3. The nozzle according to claim 1, further comprising:

a first wall and a first bulkhead configured to cooperatively isolate the fuel volume from the airflow line; and a second bulkhead configured to isolate the fuel volume from the combustion zone.

4. The nozzle according to claim 3, further comprising a set of tubes extending from the first bulkhead to the second bulkhead and to thereby allow for the provision of the air from the airflow line to the combustion zone.

5. The nozzle according to claim 4, wherein the fuse is disposed within the interior wall of the outer annulus at a location corresponding to that of the tubes.

6. The nozzle according to claim 1, wherein the fuse comprises a portion of the interior wall of the outer annulus which is sufficiently thin, such that during the flameholding incident the fuse melts in a time that is significantly shorter than the time required for the interior wall of the annulus to reach a melting temperature thereof.

7. The nozzle according to claim 1, further comprising a sensor configured to sense at least one of the melting of the fuse and a presence of the breach and to generate a signal indicative of the sensing.

8. A nozzle to avoid excess damage resulting from a flameholding incident occurring when a flame is formed and persists excessively close to nozzle hardware, comprising:

a fuel volume, defined by a wall of an annulus of the nozzle, into which fuel is fed to a distal end thereof, which is adjacent to and isolated from a combustion zone of the nozzle;

an airflow line, disposed at a radial exterior of the fuel volume at an axial location corresponding to the distal end of the fuel volume, through which air flows to the combustion zone with the airflow line and the combustion zone being isolated from the fuel volume; and a fuse disposed in the wall of the fuel volume, which is configured to melt during the flameholding incident and to thereby form a breach through which fuel flows from the distal end of the fuel volume to a fuel burning zone of the nozzle located downstream from a fuel mixing zone of the nozzle.

9. The nozzle according to claim 8, further comprising:

a first wall and a first bulkhead configured to cooperatively isolate the fuel volume from the airflow line; and a second bulkhead configured to isolate the fuel volume from the combustion zone.

10. The nozzle according to claim 9, further comprising a set of tubes extending from the first bulkhead to the second bulkhead and to thereby allow for the provision of the air from the airflow line to the combustion zone.

11. The nozzle according to claim 10, wherein the fuse is disposed at a location corresponding to that of the tubes.

12. The nozzle according to claim 8, wherein the fuse is sufficiently thin, such that during the flameholding incident, the fuse melts in a time that is significantly shorter than the time required for the wall in which the fuse is disposed to reach a melting temperature thereof.

13. The nozzle according to claim 8, further comprising a sensor configured to sense at least one of the melting of the fuse and a presence of the breach and to generate a signal indicative of the sensing.

* * * * *